US007305827B2

(12) United States Patent
Arnold et al.

(10) Patent No.: US 7,305,827 B2
(45) Date of Patent: Dec. 11, 2007

(54) INLET DUCT FOR REARWARD-FACING COMPRESSOR WHEEL, AND TURBOCHARGER INCORPORATING SAME

(75) Inventors: Steve Don Arnold, Ranch Palos Verdes, CA (US); David A. Calta, Newbury Park, CA (US)

(73) Assignee: Honeywell International, Inc., Morristown, NJ (US)

( * ) Notice: Subject to any disclaimer, the term of this patent is extended or adjusted under 35 U.S.C. 154(b) by 71 days.

(21) Appl. No.: 11/285,665

(22) Filed: Nov. 22, 2005

(65) Prior Publication Data

US 2007/0113551 A1 May 24, 2007

(51) Int. Cl.
*F02B 33/44* (2006.01)

(52) U.S. Cl. ..... 60/605.1

(58) Field of Classification Search ..... 60/602, 60/612; 415/98–100, 102, 204–206, 151
See application file for complete search history.

(56) References Cited

U.S. PATENT DOCUMENTS 2,069,640 A * 2/1937 Beardsley, Jr. ..... 415/195
2,286,522 A * 6/1942 Watson ..... 415/100
2,868,440 A * 1/1959 McMahon ..... 415/199.3
6,289,854 B1 * 9/2001 Holmstrom et al. ..... 123/41.44
6,948,314 B2 * 9/2005 Arnold et al. ..... 60/612
7,014,418 B1 * 3/2006 Arnold et al. ..... 415/100

FOREIGN PATENT DOCUMENTS

JP 04209993 A * 7/1992

* cited by examiner

*Primary Examiner*—Thomas Denion
*Assistant Examiner*—Douglas J. Duff
(74) *Attorney, Agent, or Firm*—Chris James

(57) ABSTRACT

A turbocharger includes a compressor wheel having back-to-back impellers (i.e., a forward-facing impeller and a rearward-facing impeller) mounted on the same shaft. The two impellers are independently supplied with inlet air via separate inlet ducts and discharge pressurized air to a common volute. The inlet duct for the rearward-facing impeller comprises a generally axially extending tubular conduit having an upstream end and a downstream end, the tubular conduit being bifurcated at the downstream end into a pair of separate duct branches that divide an air stream flowing through the tubular conduit into a pair of separate air streams. The duct branches direct the air streams radially inwardly and then re-join the streams and turn the air to an axial direction into the second impeller.

16 Claims, 2 Drawing Sheets

INLET DUCT FOR REARWARD-FACING COMPRESSOR WHEEL, AND TURBOCHARGER INCORPORATING SAME

BACKGROUND OF THE INVENTION

The present invention relates to turbochargers and, more particularly, to turbochargers having a centrifugal compressor that includes a pair of impellers arranged in a back-to-back configuration such that air enters one impeller in a first axial direction and air enters the other impeller in a second axial direction opposite to the first axial direction.

Conventionally turbocharged internal combustion engines employ a turbocharger having a single turbine wheel that receives exhaust gas from the engine and is driven by the exhaust gas to rotate a centrifugal compressor wheel comprising a single impeller. The impeller compresses air and delivers the air to the engine intake system, where the air is mixed with fuel and supplied to the engine cylinders for combustion. Turbocharging allows the engine to achieve higher power output than an equivalent non-turbocharged engine.

Various trends in engine design, particularly with respect to diesel engines, have made it increasingly difficult to achieve adequate turbocharger performance using a conventional single turbocharger as describe above. Such trends include increasing requirements for engine power, as well as government regulations reducing the allowable limits of $NO_x$ and particulate emissions. It has been found that a single compressor is not capable of meeting the pressure ratio and flow range requirements of some state-of-the-art engine systems.

Recognition of this problem has led to the development of various types of turbocharger systems that employ multiple compressor stages. For example, serially arranged turbochargers have been developed, in which the turbines of two turbochargers are arranged in series and the compressors are arranged in series. While such series turbochargers can achieve performance improvements over single turbochargers, they are expensive, and are bulky and hence difficult to incorporate into engine compartments that are already cramped for space.

An innovative solution to this problem is disclosed in commonly assigned U.S. Pat. No. 6,948,314 to Arnold et al. The '314 patent describes a single turbocharger having a compressor wheel comprising two impellers mounted on the same shaft and arranged in a back-to-back configuration. Each impeller has its own air inlet, and the air pressurized by each impeller is discharged into a common volute. A movable flow-control member is disposed between the compressor wheel and the volute and is movable between a first position in which both impellers discharge into the volute, and a second position in which the discharge flow path of one of the impellers is effectively shut off so that only the other impeller discharges to the volute. This compressor arrangement allows the compressor flow range to be extended, and allows the compressor wheel diameter to be reduced, relative to a conventional single compressor. The diameter reduction leads to a reduction in rotor inertia, thereby improving transient response of the turbocharger. The arrangement also facilitates matching between the compressor and turbine.

BRIEF SUMMARY OF THE INVENTION

The present invention represents a further development of the type of turbocharger disclosed in the '314 patent as noted above. In the '314 patent, air is supplied to the second impeller (i.e., the impeller located between the first impeller and the turbine wheel) through an inlet duct that is formed in part by the volute of the compressor housing. The compressor housing thus is a highly complex configuration that is difficult to cast. Additionally, the inlet air for the second impeller passes over the wall of the volute and hence there is an undesirable heat transfer from the higher-temperature air in the volute to the lower-temperature inlet air.

In accordance with one embodiment of the present invention, a turbocharger comprises a turbine wheel affixed to one end of a rotatable shaft and disposed in a turbine housing configured to direct exhaust gas from an engine into the turbine wheel for rotatably driving the turbine wheel and shaft, and a compressor wheel affixed to an opposite end of the shaft. The compressor wheel comprises a first impeller and a second impeller each having a hub and a plurality of blades extending generally radially out from the hub, the blades of each impeller defining an inducer at a front side of the impeller through which air is ingested into the impeller, each impeller having a back side opposite from the front side. The back side of the first (or "forward-facing") impeller faces toward the turbine wheel and the back side of the second (or "rearward-facing") impeller faces the back side of the first impeller. A compressor housing contains the compressor wheel, the compressor housing defining a circumferentially extending volute surrounding a radially outer periphery of the compressor wheel for receiving pressurized air discharged from each of the impellers, the compressor housing further defining a tubular first inlet duct arranged to direct air in a first axial direction into the inducer of the first impeller.

A second inlet duct is formed separately from the compressor housing for directing air into the inducer of the second impeller. The second inlet duct comprises a tubular conduit having an upstream end and a downstream end and extends generally parallel to the first axial direction. The tubular conduit is bifurcated at the downstream end into a pair of separate duct branches that divide an air stream flowing through the tubular conduit into a pair of separate air streams, each duct branch configured to turn the respective air stream from the first axial direction to a radially inward direction generally opposite to that of the other duct branch. Each duct branch has a radially inner end that joins with that of the other duct branch such that the air streams are re-joined, the radially inner ends being configured to turn the re-joined air stream to a second axial direction opposite to the first axial direction and direct the re-joined air stream into the inducer of the second impeller.

In one embodiment, the radially inner end of each duct branch has a circumferential extent of approximately 180 degrees. The two duct branches can be mirror images of each other.

The turbocharger in one embodiment includes a center housing disposed between the turbine housing and the compressor housing, the center housing defining a central bore containing bearings that rotatably support the shaft extending therethrough. The duct branches of the second inlet duct are disposed between the center housing and the compressor housing.

In one embodiment of the invention, the tubular conduit of the second inlet duct passes radially outwardly of a radially outer surface of the volute of the compressor housing. This arrangement eliminates or at least greatly reduces the heat transfer between the higher-temperature air in the volute and the lower-temperature air in the conduit.

The turbocharger in some embodiments of the invention can include a movable flow-control member disposed in the compressor housing at a location between the compressor wheel and the volute, the flow-control member being movable to various positions for variably restricting flow into the volute. The flow-control member can comprise an annular member slidably disposed in an annular space defined by the compressor housing, the annular member having a face axially spaced from a wall of the compressor housing such that a diffuser flow path is defined between the face and the wall, a flow area of the diffuser flow path being adjustable by moving the annular member within the annular space so as to adjust a spacing distance between the face and the wall.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
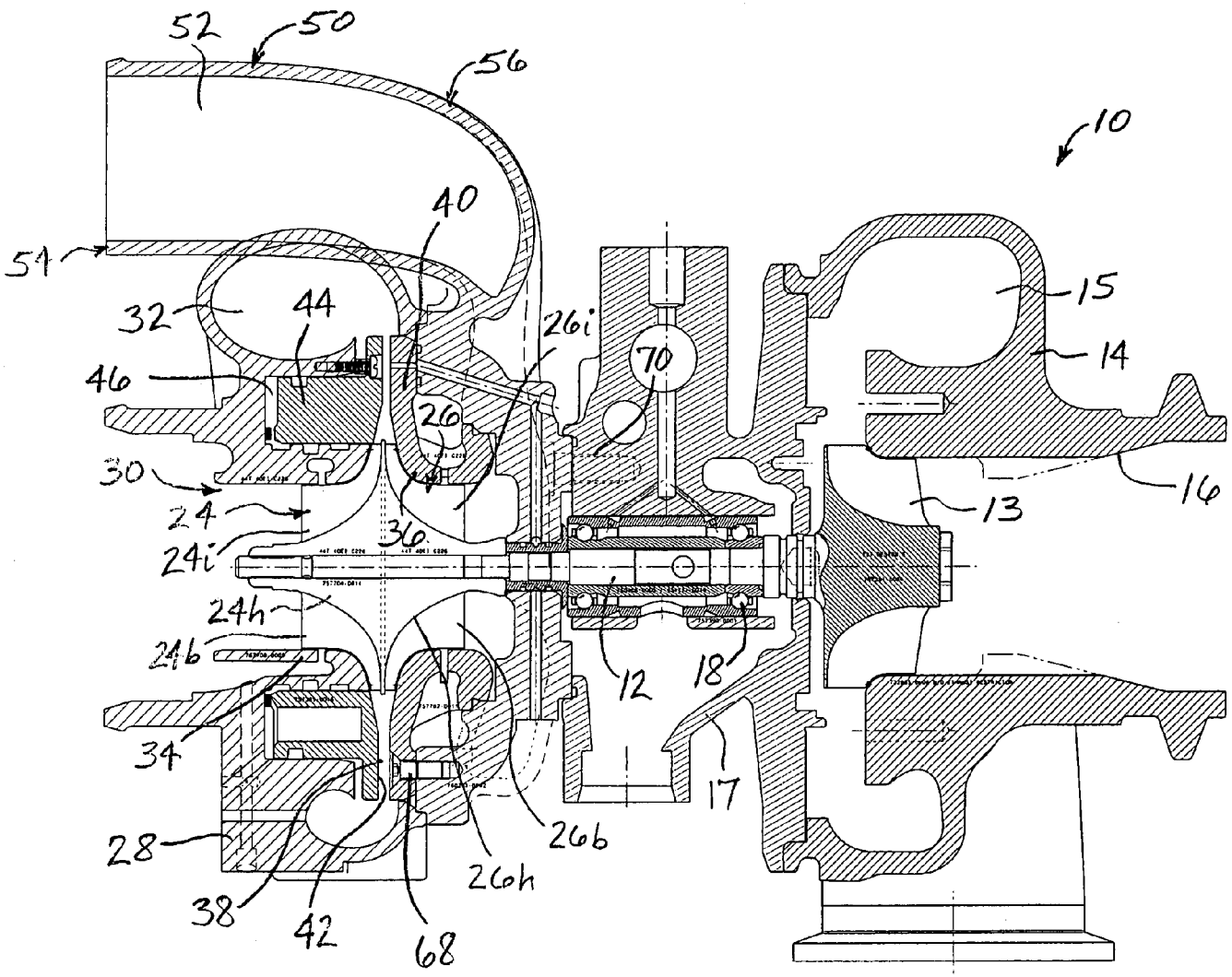
FIG. 1 is a cross-sectional view of a turbocharger in accordance with one embodiment of the invention, taken along a first axial-radial plane extending through a rotational axis of the turbocharger rotor.

FIG. 1 shows a turbocharger 10 having a twin-impeller compressor in accordance with one embodiment of the invention. The turbocharger 10 includes a rotary shaft 12 on one end of which a turbine wheel 13 is mounted. The turbine section of the turbocharger 10 includes a turbine housing 14 that defines a turbine volute 15 arranged to direct fluid to the turbine wheel. The turbine housing also defines an outlet 16. Exhaust gases from an engine (not shown) are fed into the turbine volute 15. The gases then pass through the turbine and are expanded so that the turbine wheel 13 is rotatably driven, thus rotatably driving the shaft 12. The expanded gases are discharged through the outlet 16. The turbine can be a radial turbine in which the flow enters the turbine in a generally radially inward direction; however, the invention is not limited to any particular turbine arrangement. Furthermore, the turbocharger could include means other than a turbine for driving the shaft 12, such as an electric motor.

The shaft 12 passes through a center housing 17 of the turbocharger. The center housing connects the turbine housing 14 with a compressor housing assembly 28 of the turbocharger as further described below. The center housing contains bearings 18 for the shaft 12.

Mounted on an opposite end of the shaft 12 from the turbine is a compressor wheel comprising a first impeller 24 and a second impeller 26. The compressor housing assembly 28 surrounds the compressor wheel. A forward portion of the compressor housing assembly defines a first inlet duct 30 leading into the first-stage impeller 24. The first inlet duct has a hollow cylindrical or tubular configuration. The compressor housing assembly defines a volute 32 surrounding the radially outer periphery of the compressor wheel for receiving pressurized air from the impellers 24, 26.

The first impeller 24 has a hub **24*h* and a plurality of blades 24*b* extending generally radially outwardly from the hub. The first impeller blades at their leading edge portions define an inducer 24*i* into which air is drawn from the first inlet duct 30 in a first axial direction (left-to-right in FIG. 1) into the inducer. The inducer 24*i* defines the upstream or front side of the first impeller 24. The first impeller has an opposite or back side, and the second impeller 26 also has a back side that faces the back side of the first impeller. The second impeller further comprises a hub 26*h* and blades 26*b* that define an inducer 26*i* at their leading edge portions. The opposite orientation of the second impeller 26 (which is referred to herein as "rearward-facing" as opposed to the forward-facing first impeller) relative to the first impeller 24 means that the inducer 26*i* of the second impeller draws air axially into the inducer in a second axial direction (right-to-left in FIG. 1**) that is opposite to the first axial direction for the first impeller.

The impellers 24, 26 can formed separately from each other, or alternatively can be formed together as an integral, one-piece structure. The impellers can be secured to the shaft 12 in various ways. In the illustrated embodiment of FIG. 2, each hub **24*h*, 26*h*** has a bore extending entirely through the hub and the shaft passes through the bores of the impellers. A nut (not shown) can be threaded onto an end of the shaft projecting out from the front side of the bore through the first impeller. Alternatively, an end portion of the shaft can be threaded and can engage an internally threaded portion of the bore in the first impeller. Yet another alternative is to employ a so-called "boreless" joint; in the case of separately formed impellers, a bore extends entirely through the second impeller and a blind bore extends partially through the first impeller and the shaft is threaded and engages internal threads in the blind bore. In the case of an integral one-piece compressor wheel, a blind bore extends partially through the wheel and is secured thereto by threads.

The compressor defines a first flow path through the first impeller 24, defined between the hub **24*h* and a first shroud 34 formed by a portion of the compressor housing assembly 28. The radially outer tips of the impeller blades 24*b* are disposed closely adjacent the first shroud 34. A second flow path is defined through the second impeller 26 between the hub 26*h* and a second shroud 36 formed by a portion of the compressor housing assembly. The blades of each of the impellers 24, 26 compress the air flowing along the respective flow paths. At the radially outer periphery of each impeller, the air is discharged into a common diffuser 38, and the air flows through the diffuser into the volute 32**.

The diffuser 38 has variable geometry for regulating air flow into the volute 32. More particularly, the diffuser is defined in part by a fixed wall 40 of the compressor housing assembly that comprises a radially outward extension of the second shroud 36. The opposite wall of the diffuser 38 is defined by a face 42 of a movable flow-control member 44. The flow-control member 44 in the illustrated embodiment comprises an annular member disposed in an annular space 46 defined by the compressor housing assembly 28. The annular space 46 is concentric with the rotational axis of the shaft 12 and is located radially inwardly of the volute 32.

The flow-control member 44 is slidable in the axial direction within the space 46, and seals (not shown) are disposed between the member 44 and the inner walls of the space 46 to discourage pressurized air from flowing therebetween. The flow-control member 44 is movable to various positions for regulating the axial width and hence the flow area of the diffuser flow path, generally as described in U.S. Pat. No. 6,948,314, incorporated herein by reference. The flow-control member thus enables the flow characteristics of the compressor to be regulated in various ways depending on operational requirements.

Figure 3:
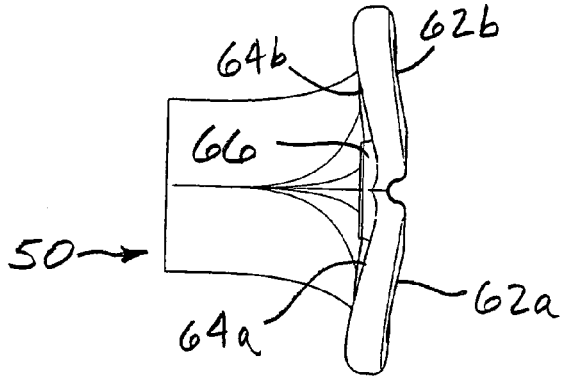
FIG. 3 is a side elevation of the second inlet duct.
Figure 4:
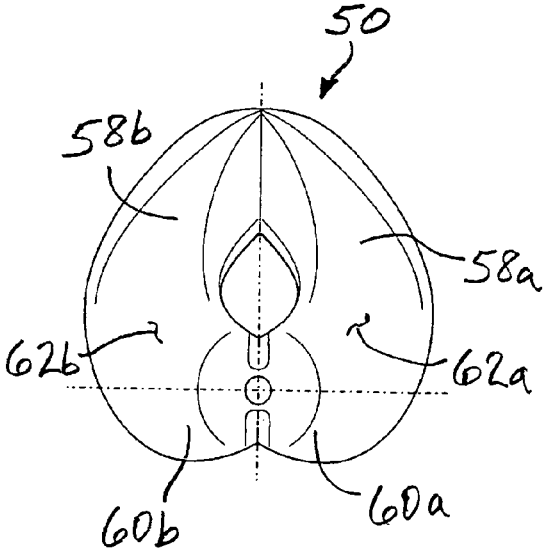
FIG. 4 is an end elevation (as viewed in a right-to-left direction in FIG. 3) of the second inlet duct.

The turbocharger 10 further comprises a second inlet duct 50 formed separately from the compressor housing assembly 28, and in particular formed separately from the volute 32, for directing air into the second impeller 26. The second inlet duct 50 is shown in isolation in FIGS. 2 through 4. The second inlet duct includes a tubular conduit 52 that has an upstream end 54 and a downstream end 56. When the second inlet duct is assembled with the turbocharger, the tubular conduit 52 extends generally parallel to the first axial direction along which air is drawn into the first impeller 24. The second inlet duct at the downstream end 56 of the conduit 52 bifurcates into a pair of duct branches 58*a* and 58*b* that divide the air stream flowing through the conduit 52 into a pair of separate air streams. Each duct branch is configured to turn the respective air stream from the first axial direction to a radially inward direction generally opposite to that of the other duct branch, as most apparent from FIG. 4. Each duct branch 58*a*, 58*b* has a radially inner end 60*a*, 60*b* that joins with that of the other duct branch such that the air streams are re-joined, the radially inner ends being configured to turn the re-joined air stream to a second axial direction opposite to the first axial direction and direct the re-joined air stream into the inducer of the second impeller.

Figure 2:
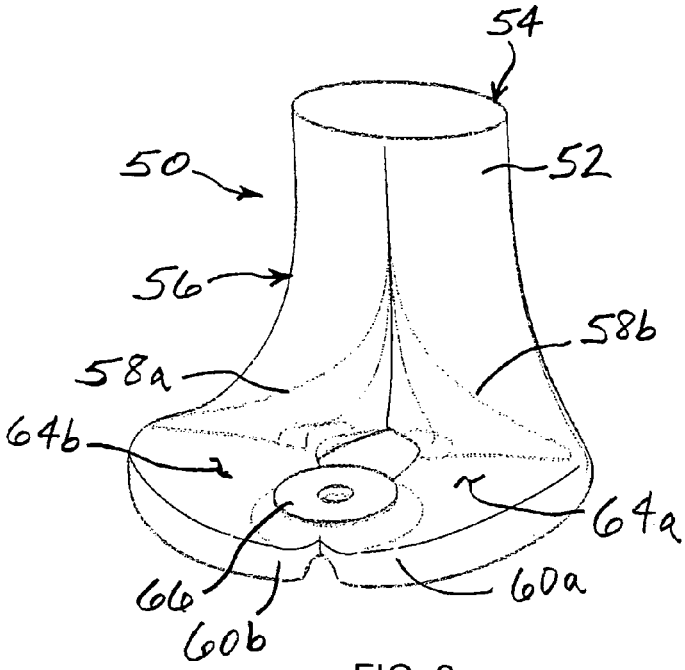
FIG. 2 is an isometric view of the second inlet duct for the second impeller.

More specifically, each duct branch 58*a*, 58*b* initially has a generally axially extending tubular configuration at the downstream end 56 of the conduit 52 and then turns toward a circumferential direction generally opposite to that of the other duct branch. The axial progression of the air stream in each duct branch 58*a*, 58*b* is halted by an end wall 62*a*, 62*b* that is generally perpendicular to the first axial direction along which the conduit 52 extends. Each duct branch has an opposite end wall 64*a*, 64*b* located opposite and axially spaced from the end wall 62*a*, 62*b*. The respective separate air streams flow generally radially inwardly along the space defined between the end walls 62*a,b* and 64*a,b*. Each of the radially inner ends 60*a*, 60*b* of the duct branches extends about 180 degrees in circumferential extent. As best seen in FIG. 2, the radially inner ends 60*a*, 60*b* join with a 360-degree tubular outlet 66 of short axial extent configured to direct the air along the second axial direction into the second impeller 26.

As depicted in FIG. 1, the second inlet duct 50 is configured so that part of the duct is mounted between the compressor housing assembly 28 and the center housing 17. More particularly, the duct branches 58*a,b* extend from the conduit 52 radially inwardly between the compressor housing assembly and the center housing. The end walls 64*a,b* abut the compressor housing assembly 28 and are fastened thereto using suitable threaded fasteners 68 or the like, and the end walls 62*a,b* abut the center housing 17 and are fastened thereto using suitable threaded fasteners 70 or the like. The tubular conduit 52 passes radially outwardly of a radially outer surface of the volute 32. Thus, there is greatly reduced heat transfer between the higher-temperature air in the volute 32 and the lower-temperature air in the conduit 52, compared with the turbocharger described in U.S. Pat. No. 6,948,314 wherein the volute and the inlet duct for the second impeller share a common wall, as previously noted. The provision of the separately formed second inlet duct 50 also simplifies the compressor housing relative to that of the '314 patent.

The duct branches of the second inlet duct 50 provide an inflow of air to the outlet 66 that is approximately radial and approximately uniform around the circumference. Accordingly, after the air is turned by the outlet 66 to flow in the second axial direction, the flow entering the second impeller 26 has substantially no swirl component of velocity, and thus no deswirl vanes are required in the second inlet duct. This is a performance advantage because deswirl vanes represent an additional source of loss that degrades overall compressor efficiency.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A turbocharger, comprising:

a turbine wheel affixed to one end of a rotatable shaft and disposed in a turbine housing configured to direct exhaust gas from an engine into the turbine wheel for rotatably driving the turbine wheel and shaft;

a compressor wheel affixed to an opposite end of the shaft, the compressor wheel comprising a first impeller and a second impeller each having a hub and a plurality of blades extending generally radially out from the hub, the blades of each impeller defining an inducer at a front side of the impeller through which air is ingested into the impeller, each impeller having a back side opposite from the front side, the back side of the first impeller facing toward the turbine wheel and the back side of the second impeller facing the back side of the first impeller;

a compressor housing containing the compressor wheel, the compressor housing defining a circumferentially extending volute surrounding a radially outer periphery of the compressor wheel for receiving pressurized air discharged from each of the impellers, the compressor housing further defining a tubular first inlet duct arranged to direct air in a first axial direction into the inducer of the first impeller; and a second inlet duct formed separately from the compressor housing for directing air into the inducer of the second impeller, the second inlet duct comprising a tubular conduit having an upstream end and a downstream end and extending generally parallel to the first axial direction, the tubular conduit being bifurcated at the downstream end into a pair of separate duct branches that divide an air stream flowing through the tubular conduit into a pair of separate air streams, each duct branch configured to turn the respective air stream from the first axial direction to a radially inward direction generally opposite to that of the other duct branch, each duct branch having a radially inner end that joins with that of the other duct branch such that the air streams are re-joined, the radially inner ends being configured to turn the re-joined air stream to a second axial direction opposite to the first axial direction and direct the re-joined air stream into the inducer of the second impeller.

2. The turbocharger of claim 1, wherein the radially inner end of each duct branch has a circumferential extent of approximately 180 degrees.

3. The turbocharger of claim 1, further comprising a center housing disposed between the turbine housing and the compressor housing, the center housing defining a central bore containing bearings that rotatably support the shaft extending therethrough.

4. The turbocharger of claim 3, wherein the duct branches of the second inlet duct are disposed between the center housing and the compressor housing.

5. The turbocharger of claim 1, wherein the tubular conduit of the second inlet duct passes radially outwardly of a radially outer surface of the volute of the compressor housing.

6. The turbocharger of claim 1, wherein the two duct branches are mirror images of each other.

7. The turbocharger of claim 1, further comprising a movable flow-control member disposed in the compressor housing at a location between the compressor wheel and the volute, the flow-control member being movable to various positions for variably restricting flow into the volute.

8. The turbocharger of claim 7, wherein the flow-control member comprises an annular member slidably disposed in an annular space defined by the compressor housing, the annular member having a face axially spaced from a wall of the compressor housing such that a diffuser flow path is defined between the face and the wall, a flow area of the diffuser flow path being adjustable by moving the annular member within the annular space so as to adjust a spacing distance between the face and the wall.

9. The turbocharger of claim 1, wherein the second inlet duct is free of deswirl vanes.

10. An inlet duct for directing air into an inducer of a second impeller in a centrifugal compressor having first and second impellers arranged in a back-to-back configuration and rotatable about a central axis such that air entering an inducer of the first impeller flows in a first axial direction and air entering the inducer of the second impeller flows in a second axial direction opposite to the first axial direction, the inlet duct comprising:

a tubular conduit having an upstream end and a downstream end and extending generally parallel to the first axial direction, the tubular conduit being located entirely to one side of the central axis, the tubular conduit being bifurcated at the downstream end into a pair of separate duct branches that divide an air stream flowing through the tubular conduit into a pair of separate air streams, wherein each duct branch initially has a generally axially extending tubular configuration at the downstream end of the conduit and then turns toward a circumferential direction generally opposite to that of the other duct branch, each duct branch being further configured to turn the respective air stream to a radially inward direction generally opposite to that of the other duct branch and toward the central axis, each duct branch having a radially inner end that joins with that of the other duct branch such that the air streams are re-joined, the radially inner ends configured to turn the re-joined air stream to the second axial direction and direct the re-joined air stream into the inducer of the second impeller as an annular stream encircling the central axis.

11. The inlet duct of claim 10, wherein the radially inner end of each duct branch has a circumferential extent of approximately 180 degrees.

12. The inlet duct of claim 10, wherein the two duct branches are mirror images of each other.

13. The inlet duct of claim 10, wherein each duct branch has a first end wall that is generally perpendicular to the first axial direction and halts the axial progression of the air stream in the duct branch, each duct branch further having an opposite second end wall located opposite and axially spaced from the first end wall, the respective separate air streams in the duct branches flowing generally radially inwardly along a space defined between the first and second end walls.

14. The inlet duct of claim 13, wherein the radially inner ends of the duct branches join with a tubular outlet configured to direct the air along the second axial direction into the second impeller.

15. The turbocharger of claim 1, wherein the first and second impellers are formed separately from each other.

16. The turbocharger of claim 1, wherein the first and second impellers are formed together as an integral, one-piece structure.

* * * * *